United States Patent [19]

Ullenboom

[11] Patent Number: 4,553,863

[45] Date of Patent: Nov. 19, 1985

[54] METHOD AND ARRANGEMENT FOR TOLERANCE COMPENSATION IN MATRIX PRINTING DEVICES

[75] Inventor: Hermann Ullenboom, Deisenhofen, Fed. Rep. of Germany

[73] Assignee: Siemens Aktiengesellschaft, Berlin & Munich, Fed. Rep. of Germany

[21] Appl. No.: 666,736

[22] Filed: Oct. 31, 1984

[30] Foreign Application Priority Data

Nov. 3, 1983 [DE] Fed. Rep. of Germany ..... 3339776

[51] Int. Cl.[4] ..... B41J 3/12; B41J 19/30

[52] U.S. Cl. ..... 400/121; 400/322

[58] Field of Search ..... 101/93.04, 93.05; 400/121, 124, 320, 322, 323, 342

[56] References Cited

U.S. PATENT DOCUMENTS

| | | | |
|---|---|---|---|
| 4,076,111 | 2/1978 | Robinson et al. | 400/322 X |
| 4,195,938 | 4/1980 | Velazquez | 400/323 X |
| 4,208,137 | 6/1980 | Liu | 400/323 X |
| 4,284,362 | 8/1981 | Jackson et al. | 400/323 X |
| 4,448,553 | 5/1984 | Yonezawa et al. | 400/121 |

FOREIGN PATENT DOCUMENTS

| | | |
|---|---|---|
| 3238165 | 4/1983 | Fed. Rep. of Germany . |
| 2398613 | 2/1979 | France . |
| 2109965 | 6/1983 | United Kingdom . |

*Primary Examiner*—Paul T. Sewell

*Attorney, Agent, or Firm*—Hill, Van Santen, Steadman & Simpson

[57] ABSTRACT

A method and apparatus for tolerance compensation in matrix printing devices. A time duration is defined between the edge of a scan clock period formed by sensing motion of a printer carriage and a criterion formed at a start of a printing line. The time duration is identified in a measuring operation executed before the actual printing event and is compared to an upper and to a lower time threshold. If the time duration is below the lower time threshold or above the upper threshold, an output signal is emitted which delays a start of the print clock generation at a beginning of the printing line for the following actual print event.

6 Claims, 3 Drawing Figures

METHOD AND ARRANGEMENT FOR TOLERANCE COMPENSATION IN MATRIX PRINTING DEVICES

BACKGROUND OF THE INVENTION

The invention relates to a method and apparatus for tolerance compensation in matrix printing devices wherein a start of a print clock generation is initiated by a criterion generated at a line start, said print clock generation being dependent upon a scanning clock generated by sensing motion of the printer carriage.

Print heads of dot-matrix printers, as is known, comprise print elements such as needles which are positioned in one or in a plurality of rows. The drive of the individual print elements with information contained in a character generator respectively occurs column-wise, i.e. a column or print clock is supplied to the print head after the print head has moved by a column spacing. The print clock thus defines the point in time at which the print elements are actuated. Every character can be constructed in grid-like fashion on the recording medium in this manner.

As is generally known, the print events always occur during the movement of the print head with constant velocity. The formation of the print clock can thus occur by means of sensing a so-called printer carriage carrying the print head or by sensing the drive means driving the printer carriage. In detail, this occurs such that a sensing system coupled to the drive means, for example a timing disk, is opto-electronically scanned and the scan clocks thus formed are supplied to a control clock generator, for example a PLL circuit, in which a so-called higher-frequency control clock is formed. This is available to a print clock generator which then generates the print clocks. Control and print clocks are respectively generated only during the actual printing operation, i.e. no printing occurs during the acceleration and during the braking of the printer carriage. For this purpose, a criterion formed at the line beginning is interpreted, and which is produced for example by actuation of the so-called line start contact. This criterion, which is generated for example by closing the line start contact at the beginning of a printing line, can be exploited in order to switch on the control clock generator, so that this starts to work with a defined edge of the next scan clock.

The following problem thus occurs. Due to influence of the scanning system (for example, belt dilation, tolerance of the timing disk, etc.) which cannot be avoided or can only be avoided with extremely high expense or due to a functioning of the line start contact that is not absolutely constant, the line start contact can, as viewed chronologically, be actuated in the immediate proximity of a defined edge of the scan clock. That means that the turn-on criterion for the control clock generator which is conditioned by this appears shortly before the defined edge in one instance and shortly after the defined edge of the scan clock at some other time. That leads to a shift of the control clocks, and thus to a shift of the print clocks. The start of printing can thus occur too late or too early by one period of the scan clock. In the final analysis, this leads to a disruptive print offset or mismatch at the line beginning and to a very unsteady print image.

SUMMARY OF THE INVENTION

An object of the invention is to specify a tolerance compensation by which a print offset or mismatch is avoided.

This object is achieved in accordance with the invention by identifying a time duration between a leading edge of a first scan clock period formed after a speed of the printer carriage has been reached, and the criterion formed at the line start during a single complete line pass of the printer carriage before an actual printing event. The measured time duration is compared to a lower and to an upper time threshold. A time delay is set when the measured time duration falls below a lower time threshold and when it exceeds an upper time threshold. The time delay delays evaluation of the criterion formed at the line start at least for a following actual printing event.

The essential advantage of the invention is that a uniform printing start is always assured without additional mechanical balancing means for the signals triggering the operation, i.e. for the scan clock and/or for the criterion formed at the line beginning.

DESCRIPTION OF THE PREFERRED EMBODIMENTS

Figure 1:
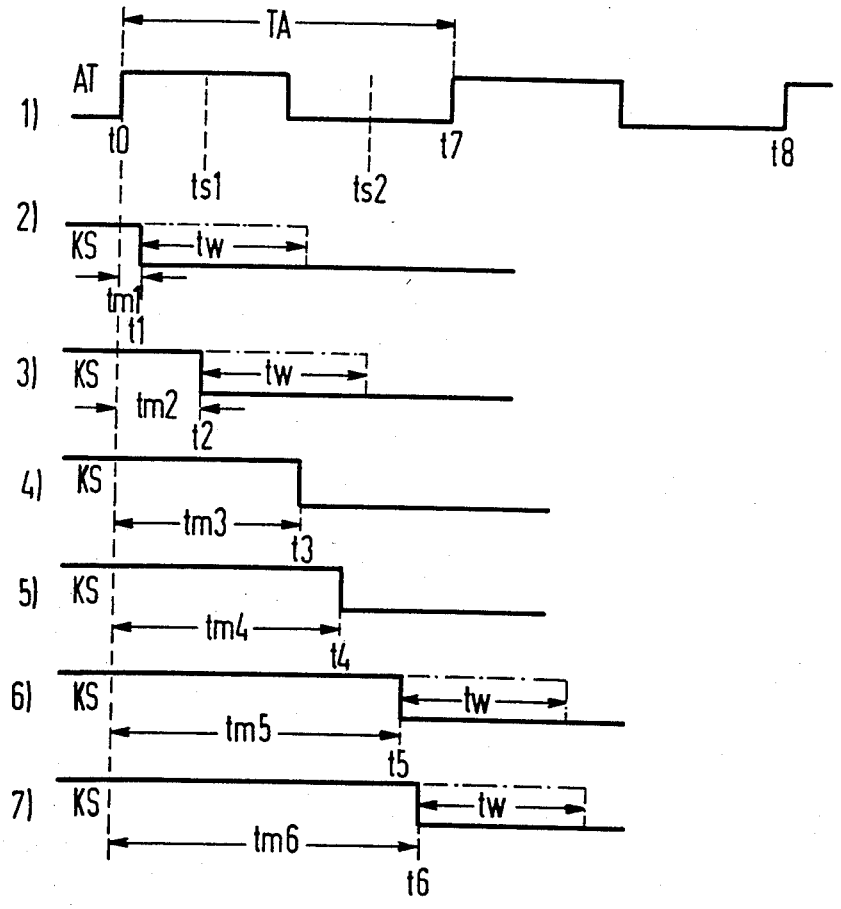
FIG. 1 is a clock rate having the essential details necessary for an understanding of the invention.

It is assumed for illustration in FIG. 1 that the printer carriage has reached the speed required for the printing event at point t0. The scan clock AT shown in line 1 has a constant frequency after time t0. Only one clock period TA of the scan clock AT is shown in the example. Lines 2 through 7 show six different cases which respectively differ from one another in that the criterion KS for the line start appears at six different times t1 through t6. In the cases shown in lines 2 and 3 as well as in lines 6 and 7, for example, the line start contact is respectively actuated relatively close to the defined edge given in this example by the leading edge of the scan clock AT at time t0. A shift of the points in time t1, t2, or t5, t6 which, as mentioned above cannot be influenced, would lead to a dislocation of the start of the actual printing event by one respective period TA of the scan clock AT.

Given the measuring operation of the invention before the actual printing event, the time duration between the appearance of the first defined edge of the scan clock at time t0 and the appearance of the line start criterion KS at times t1 through t6 is identified. These time durations or measuring times are referenced tm1 through tm6 in FIG. 1. When this time duration lies within a value determined by two time thresholds ts1 and ts2, then a waiting time tw is respectively formed for the later actual printing event formed after the first defined edge of the first scan clock, and thus is related to the time t0; i.e. the events initiated by the actuation of the line start contact are initiated in delayed fashion by the waiting time tw. This delay is shown in FIG. 1 by means of a dot-dash line.

It is advantageous for practical applications to define a threshold for the measuring time tm which corresponds roughly to one-fourth or three-fourths of the duration of a period TA of a scan clock AT. The waiting time tw can advantageously correspond to about half a duration of the period of a scan clock AT. Based upon these determinations, the waiting times tw are respectively formed in accordance with the example shown in FIG. 1 in the cases of lines 2 and 3 as well as lines 6 and 7. For all events occurring after such a measuring operation, thus the interpretation of the actuation of the line start contact does not take effect until after a delay by the waiting time tw. It is thus assured that a defined start for the generation of the print clock is respectively guaranteed for the subsequent printing events. Such a delay is suppressed in the cases shown in lines 4 and 5. In practice, thus the generation of the print clock in the cases shown in lines 2 through 5 will always begin at time t7 and will always begin at time t8 in the cases shown in lines 6 and 7.

Figure 2:
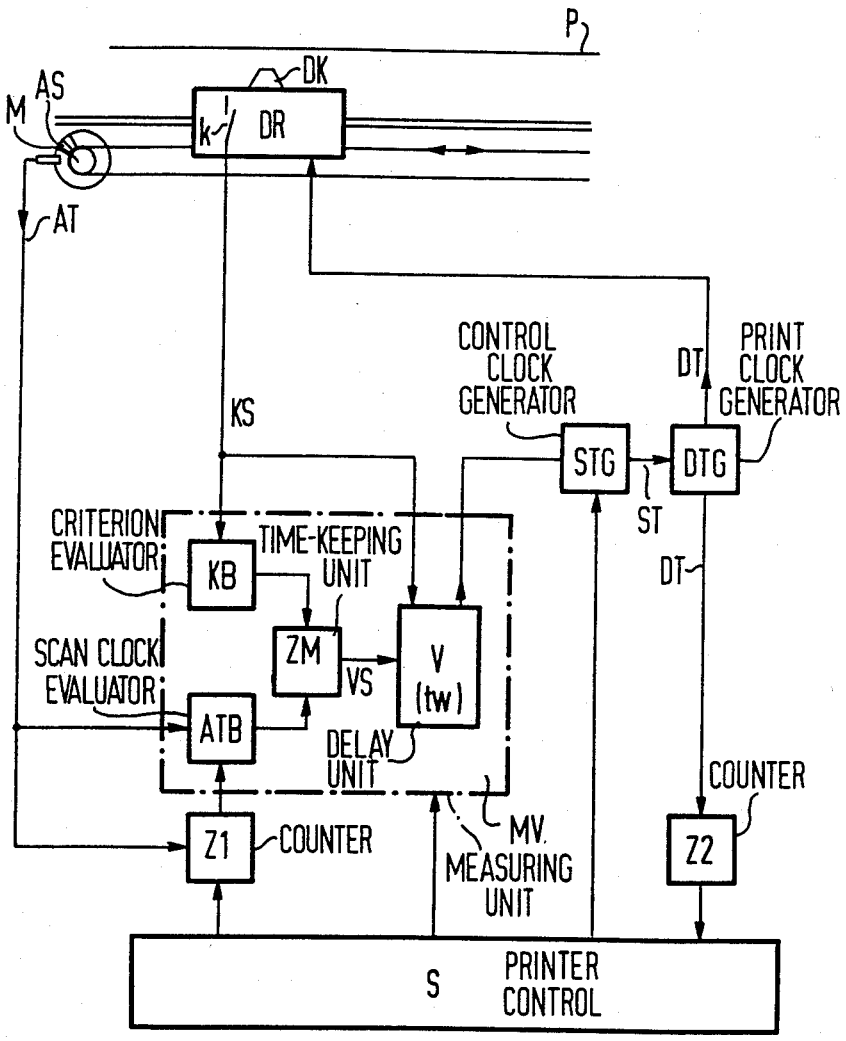
FIG. 2 is an illustrative embodiment of a circuit arrangement in accordance with the invention.

An illustrative embodiment of the circuit arrangement is shown in FIG. 2. The example shows a printer carriage DR which carries the actual print head DK with the print elements. The printer carriage is moved back and forth in a line direction in front of a recording medium P, and is moved by means of a drive system M. The drive system M has a sensing system AS, for example an opto-electronically read timing disk allocated to it, the sensing system emitting the scan clocks AT. A control clock generator STG, a print clock generator DTG, and counters Z1 and Z2 are provided for generating the print clocks DT. The control of these units occurs proceeding from a printer control S. The measuring unit MV consists of an evaluator ATB for the scan clocks and an evaluator KB for the criterion KS emitted at the beginning of the line, the criterion KS being formed here by actuation of the line start contact K. A timekeeping means ZM and a delay means V are also provided. The functioning of the arrangement is, in detail, as follows.

Before the start of a printing operation, the measuring unit MV is switched on via the control S. In this case, the criterion output by the counter Z1 is available with which the position of the printer carriage DR at the end of an acceleration phase is determined. This can occur, for example, by means of counting off the scan clocks AT during the acceleration phase of the printer carriage DR. The first edge of the scan clock AT thus defined (time t0 in FIG. 1, line 1) activates the time-keeping means ZM via the evaluator ATB. This timekeeping means ZM is switched off when the criterion KS (actuation of the line start contact k) has been recognized in the evaluator KB. Dependent upon whether the measured chronological duration tm is below the first time threshold ts1 or lies above the second time threshold ts2, i.e. less than or greater than one-fourth TA, less than or greater than three-fourths TA in the example, a signal VS is emitted. When the signal VS is available, then the delay circuit V is switched on and all subsequent events which are initiated by the criterion KS formed upon actuation of the line start contact k are delayed by the waiting time tw. This delay is suppressed when the signal VS is not output.

When the printing events are now executed subsequent to a measuring event, then the delay tw is either taken into consideration at every line beginning (FIG. 1, lines 2 and 3 or, respectively, 6 and 7) or is not taken into consideration (FIG. 1, lines 4 and 5). Although the generation of the print clock is no longer a subject matter of the invention, it shall be briefly discussed. Dependent upon the arrival of the criterion KS (actuation of the line start contact k), a higher-frequency control clock ST is generated in the control clock generator STG which, for example, contains a so-called PLL circuit among other things. The control clock ST is generated dependent on the scan clocks AT beginning with the first leading edge of the scan clock AT after time t7 or t8 in FIG. 1. The actual print clocks DT are generated by the print clock generator DTG. The shut-off of the control clock generator STG and of the print clock generator DTG at the end of a printing line can occur by counting off the print clocks DT in the counter Z2. The printer carriage DR is then braked and then accelerated again after reversal of the moving direction. The print clocks DT for printing in a return direction are then subsequently generated again in the manner described.

The described measuring operation and the determination of a waiting time thus defined respectively occurs in a single pass before the printing operation, and thus require no noticeable time.

Figure 3:
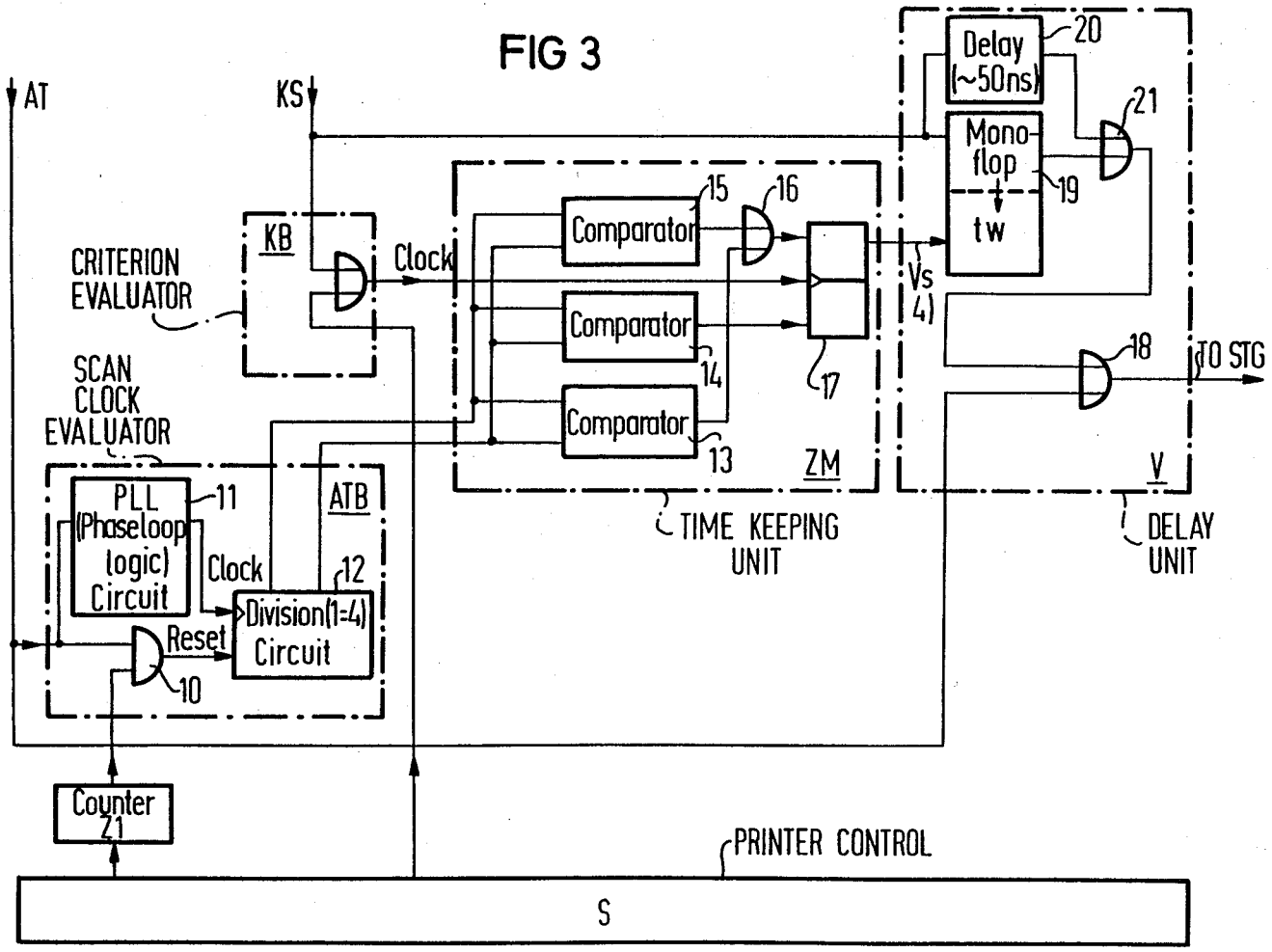
FIG. 3 is a block diagram of the measuring unit MV shown in FIG. 2.

A preferred embodiment of the measuring unit MV is illustrated in FIG. 3. As shown there, the scan clock evaluator ATB includes a phase lock loop logic circuit 11 formed of integrated circuit SN74197 which outputs together with gate 10 to division circuit 12 formed of integrated circuit SN74197. Gate 10 formed of IC SN7408 receives inputs from counter Z1 and input line AT.

Division circuit 12 outputs to the time-keeping unit ZM containing three comparators 13, 14, and 15 each formed of IC SN7485. The three comparators output to gate 16 formed of IC SN7432 to flip-flop 17 formed of IC SN7473. Flip-flop 17 outputs to the delay unit V formed of gate 21 receiving inputs from delay 20 and monoflop 19. Monoflop 19 is formed of IC 74121 and gate 21 is formed of IC SN7432. Gate 18 formed of SN7432 outputs to control clock generator STG and receives inputs from gate 21 and line AT. Gate 18 is formed of IC SN7432.

For the circuit shown in FIG. 3, the following relations are true:

(1) $tm < ts1$ (2) $ts1 < tm < ts2$ (3) $tm > ts2$ (4) $Vs \equiv 1$: waiting time $Vs \equiv 0$: no waiting time.

The above-identified integrated circuit numbers are from the TTL Cookbook of Texas Instruments.

Although various minor changes and modifications might be proposed by those skilled in the art, it will be understood that I wish to include within the claims of the patent warranted hereon all such changes and modifications as reasonably come within my contribution to the art.

I claim as my invention:

1. In a method for tolerance compensation in a matrix printing device having a printer carriage wherein a start of a print clock generation is initiated by a criterion generated at a line start, and said print clock generation is dependent upon a scan clock generated by sensing motion of the printer carriage, said printer carriage moving before a printing event, wherein the improvement comprises the steps of:

defining and measuring a time duration between a leading edge of a scan clock period of the scan clock and said criterion formed at the line start, said scan clock period being formed after a speed of the printer carriage used for printing events has been reached, and said time duration being defined and measured during a single complete line pass of said printer carriage before the actual printing event;

comparing the measured time duration to a lower and to an upper time threshold;

setting a time delay when the measured time duration is below said lower time threshold or when it exceeds said upper time threshold; and said time delay delaying evaluation of said criterion formed at the line start at least for a following actual printing event.

2. A method according to claim 1 including the step of defining said lower and upper time thresholds as well as said time delay dependent upon a duration of the period of the scan clock.

3. A method according to claim 2 wherein said lower time threshold is approximately one-fourth the duration of the period of the scan clock and said upper time threshold is approximately three-fourths of the duration of the period of the scan clock; and said time delay corresponding approximately to one-half of the duration of the period of the scan clock.

4. In an apparatus for tolerance compensation in a matrix printing device having a printer carriage wherein a start of a print clock generation is initiated by a criterion generated at a line start, and said print clock generation is dependent upon a scan clock generated by sensing motion of the printer carriage, said printer carriage moving before a printing event, wherein the improvement comprises:

means for defining and measuring a time duration between a leading edge of a scan clock period of the scan clock and said criterion formed at the line start, said scan clock period being formed after a speed of the printer carriage used for printing events has been reached, and said time duration being defined and measured during a single complete line pass of said printer carriage before the actual printing event;

means for comparing the measured time duration to a lower and to an upper time threshold;

means for setting a time delay when the measured time duration is below said lower time threshold or when it exceeds said upper time threshold; and means for delaying evaluation by said time delay of said criterion formed at the line start at least for a following actual printing event.

5. An apparatus according to claim 4 wherein said measuring means comprises a criterion evaluator means for said criterion formed at the line start, a scan clock evaluator means for evaluating the edge of the scan clock periods, said scan clock evaluator means being switched on after a position of the printer carriage provided for a start of a printing event has been reached, a time keeping circuit means connected to said criterion evaluator means and scan clock evaluator means for identifying said time duration between the leading edge of the scan clock period evaluated in the scan clock evaluator means and the criterion formed at the line start.

6. An apparatus according to claim 5 wherein line start contact means is provided for forming said criterion at said line start when the line start contact means is actuated.

* * * * *